US006039790A

United States Patent [19]

Hultholm et al.

[11] Patent Number: 6,039,790

[45] Date of Patent: Mar. 21, 2000

[54] METHOD FOR RECOVERING NICKEL HYDROMETALLURGICALLY FROM TWO DIFFERENT NICKEL MATTES

[75] Inventors: Stig-Erik Hultholm, Pori; Sigmund Peder Fugleberg, Turku, both of Finland

[73] Assignee: Outkumpu Technology Oy, Espoo, Finland

[21] Appl. No.: 09/011,228

[22] PCT Filed: Aug. 6, 1996

[86] PCT No.: PCT/FI96/00432

§ 371 Date: Feb. 5, 1998

§ 102(e) Date: Feb. 5, 1998

[87] PCT Pub. No.: WO97/07248

PCT Pub. Date: Feb. 27, 1997

[30] Foreign Application Priority Data

Aug. 14, 1995 [FI] Finland ..... 953832

[51] Int. Cl.[7] ..... C21B 15/00

[52] U.S. Cl. ..... 75/739; 423/146; 423/150.3; 423/150.4

[58] Field of Search ..... 75/739, 741; 423/146, 423/150.4, 140, 150.5, 150.3

[56] References Cited

U.S. PATENT DOCUMENTS

| | | | |
|---|---|---|---|
| 3,793,432 | 2/1974 | Weston . | |
| 4,024,218 | 5/1977 | McKay et al. . | |
| 4,042,474 | 8/1977 | Saarinen . | |
| 4,301,125 | 11/1981 | Burkin et al. . | |
| 4,323,541 | 4/1982 | Saarinen et al. . | |
| 4,431,613 | 2/1984 | Verbaan . | |
| 5,344,479 | 9/1994 | Kerfoot et al. | 75/743 |

*Primary Examiner*—Prince Willis
*Assistant Examiner*—Tima McGuthry-Banks
*Attorney, Agent, or Firm*—Smith-Hill and Bedell

[57] ABSTRACT

The invention relates to a method for recovering nickel in one and the same process from two pyrometallurgically produced nickel mattes, one of which contains a remarkable percentage or iron. The leaching of iron-bearing nickel matte is carried out in one step by conducting solution from the leaching cycle of a less iron containing matte into the leaching of a more iron containing matte at a stage where the iron of the less iron containing matte is in soluble form. The iron contained in the mattes is advantageously precipitated as jarosite and the solution created in the leaching of the more iron containing matte is conducted back into the leaching cycle of the less iron containing matte.

18 Claims, 2 Drawing Sheets

Figure 1:
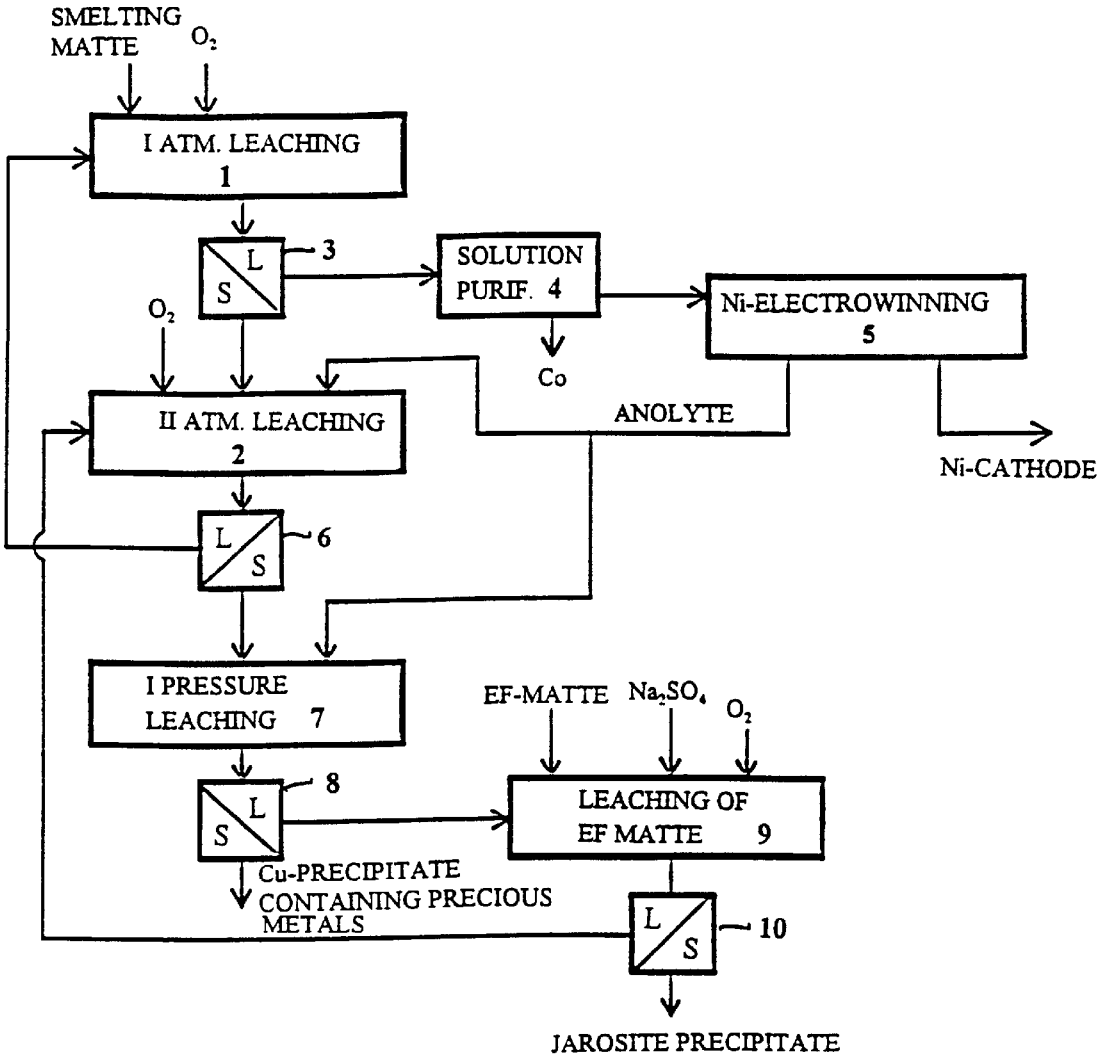

METHOD FOR RECOVERING NICKEL HYDROMETALLURGICALLY FROM TWO DIFFERENT NICKEL MATTES

The present invention relates to a method for recovering nickel in one and the same process from two pyrometallurgically produced nickel mattes, one of which contains a remarkable percentage of iron. The leaching of iron-bearing nickel matte is carried out in one step by feeding the solution coming from the leaching cycle of the matte containing less iron to the leaching of iron-rich matte at a stage where the iron of the low-iron matte is in soluble form. The iron of the mattes is advantageously precipitated as jarosite, and the solution created in the leaching of iron-rich matte is conducted back into the leaching cycle of the low-iron matte.

A large part of the world's nickel is produced hydrometallurgically from sulfidic nickel mattes, which are pyrometallurgically produced. The produced mattes are mainly low-iron nickel-copper mattes, because in the hydrometallurgical further treatment the removal of iron from the process has been difficult.

In order to obtain a low iron content in the nickel matte, the pyrometallurgical treatment of nickel concentrate has generally consisted of three steps. In the first step the concentrate is smelted, and the obtained product is low-iron nickel matte, which is below called smelting matte in this specification. The employed smelting furnace can be for instance a flash smelting furnace. In addition to the matte, from the furnace there is obtained slag with a high iron content, which slag is in the second step of the process fed to an electric furnace. In the electric furnace the slag is reduced, and the obtained products are matte with a high iron content as well as slag to be discarded. In the third step both the smelting matte and the electric furnace matte are conducted into a converter, where the iron is removed by oxidation, and the matte going further to hydrometallurgical treatment is now called high-grade nickel matte.

The converting of the above described pyrometallurgical process removes iron and sulfur from the infed matte, but as a drawback this treatment also causes recovery losses, particularly as regards cobalt, but with other valuable metals, too. In this connection metals regarded as valuable metals are particularly nickel, copper and cobalt and precious metals. Consequently, the omission of the converting step improves the recovery of valuable metals and reduces the processing costs, but on the other hand requires a capacity for treating iron in a hydrometallurgical process.

The U.S. Pat. No. 4,323,541 describes a traditional method for recovering nickel from high-grade nickel matte with a remarkably low iron content. The leaching takes place in two atmospheric leaching steps plus one pressure leaching step, where the purpose is to leach the nickel contained in the high-grade nickel matte, so that the copper remains unleached. The copper-bearing precipitate from pressure leaching is returned to the copper smelting cycle.

The U.S. Pat. No. 4,042,474 describes a method wherein ferronickel, which is a nickel product with a high iron content, is treated in three leaching steps so that nickel is made to dissolve into an anolyte obtained from nickel electrowinning, and iron is made to precipitate as jarosite.

The method of the present invention is based on the fact that in pyrometallurgical treatment, the converting step is omitted, so that there are obtained two kinds of nickel matte: smelting matte and electric furnace matte, the former containing less iron and the latter having a higher iron content. The smelting matte is processed in its own cycle, in at least one atmospheric leaching step and one pressure leaching step. The electric furnace matte (EF matte) is leached in one step into a solution coming from the leaching cycle of the smelting matte, coming either from pressure leaching or from the last leaching step of atmospheric leaching, and the solution obtained from the leaching of the EF matte can be fed back into the leaching cycle of the smelting matte. The conditions in the solution coming from the leaching cycle of the smelting furnace matte to the leaching of the EF matte are adjusted to be such that iron and other impurities contained in the smelting matte are present in dissolved form and can thus be precipitated in connection with the precipitation of the iron contained in the EF matte.

The method of the present invention is based on the surprising discovery that the dissolution rate of an iron-bearing matte is not very much dependent on the acid content of the solution, but on the other hand the precipitation rate of iron is remarkably increased, when the acid content is reduced. Therefore it is important that the pH or acid content of the solution is maintained within a region where iron can be precipitated as advantageously as possible. It has been proved that by choosing a suitable acid content and delay time, the nickel contained in the EF matte can be leached practically completely in one step, and at the same time iron is precipitated so far that the solution can be returned to any leaching step of the smelting matte.

When the iron is precipitated in the leaching and precipitation step of the EF matte, there are also precipitated some elements that are harmful for the hydrometallurgical process, such as arsenic and antimonium. These elements are mainly obtained along with the smelting matte, and in certain conditions they are contained in the solution. In similar conditions it is also possible to obtain the iron into the solution in ferrous form. When the impurities (Fe, As; Sb) contained in the smelting furnace matte are obtained in the solution, and this solution is further conducted to the treatment of the EF matte, the impurities of the smelting matte can be precipitated simultaneously with the precipitation of iron. It is advantageous to precipitate the iron as jarosite, but when desired, the iron can also be precipitated as goethite.

Figure 2:
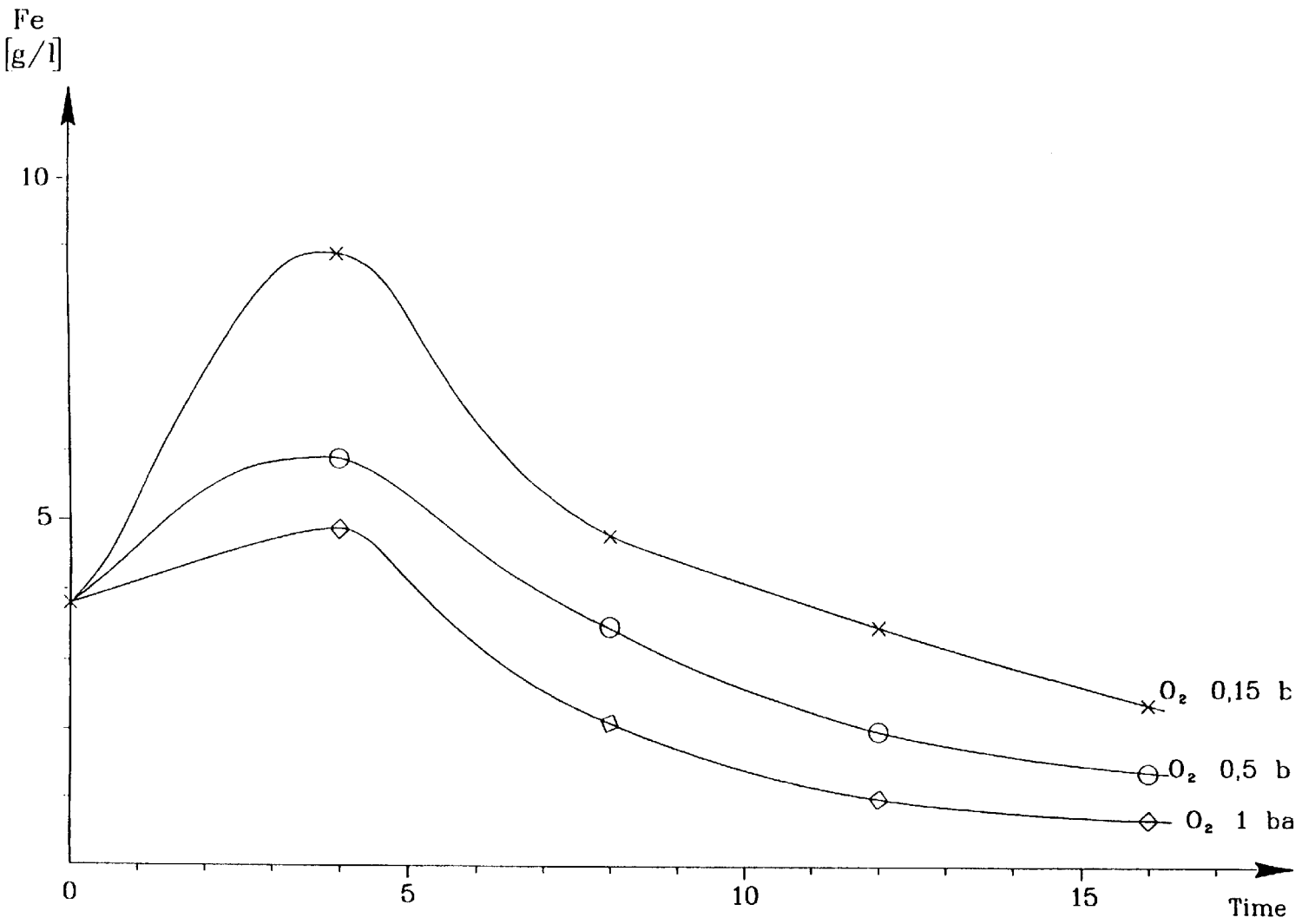

The invention is further described with reference to the accompanying drawings in which FIG. 1 is a flow chart of a process in accordance with the present invention, and FIG. 2 is a graph showing the effect of different partial pressures of oxygen on leaching of iron.

According to the flow chart shown in FIG. 1, the finely ground smelting matte, i.e. nickel-copper matte obtained from a smelting furnace, such as a flash smelting furnace, is conducted to the first atmospheric leaching step 1. Instead of nickel-copper matte, there can naturally be employed high-grade nickel matte. The nickel content of nickel-copper matte is present in several different forms, for instance as elemental nickel $Ni^0$ or nickel sulfide $Ni_3S_2$, which at this stage could be called primary sulfide, because it is obtained from smelting matte. The finely ground matte is leached with copper-sulfate-bearing nickel sulfate solution obtained from the next atmospheric leaching 2, and in addition to this into the leaching step there is fed oxygen or air. Owing to the effect of copper sulfate and oxygen, the elemental nickel and the nickel sulfide are oxidized into nickel sulfate. In the process there is also created alkalic copper sulfate and copper oxidule, which at this stage go into the precipitate. The leaching is carried out in atmospheric conditions and at the temperature of 80–100° C.

After leaching, there is carried out the separation of liquid and precipitate in step 3 according to a normal separation procedure. The nickel sulfate solution created in the leaching is conducted, after solution purification (cobalt removal) 4 into nickel electrowinning 5.

The precipitate formed in the first atmospheric leaching 1 is conducted into the second atmospheric leaching step 2, to which there is now added nickel sulfate solution obtained from a later process step, i.e. from the leaching of electric furnace matte, as well as anolyte from the nickel electrowinning 5. Owing to the effect of the free sulfuric acid (about 50 g/l) contained in the anolyte, the primary nickel sulfide contained in the nickel-copper matte is dissolved and forms one mole of nickel sulfate and two moles of secondary nickel sulfide NiS per one mole of $Ni_3S_2$. In the second atmospheric leaching step, also the primary copper sulfide, chalcocite $Cu_2S$, is dissolved when reacting with sulfuric acid and forms secondary copper sulfide CuS and copper sulfate. The previously formed alkalic copper sulfate also dissolves in these conditions and creates more copper sulfate in the solution. Oxygen (or air) is needed for leaching reactions in this step, too.

The solution created in the second atmospheric leaching 2 is conducted, after the separation step 6, to the first atmospheric leaching 1, and the copper sulfate contained in this solution leaches the elemental nickel and primary nickel sulfide contained in the matte. After the second atmospheric leaching step it can be maintained that all of the elemental nickel and primary nickel sulfide contained in the matte is virtually leached, and as for nickel compounds, the formed precipitate mainly contains secondary nickel sulfide only. Moreover, the precipitate contains unleached copper compounds, precious metals, different forms of iron previously contained in the smelting matte, as well as compounds of arsenic and antimonium.

The precipitate from the second atmospheric leaching is conducted into a third leaching step, pressure leaching 7, where the precipitate is leached by using the anolyte from nickel electrowinning. The process may also include another pressure leaching step (not illustrated in the flowchart), in which case the leaching of the first pressure leach is carried out by means of the copper sulfate solution created in this second pressure leaching step. In the third leaching step 7 the temperature is at least 110°. In an autoclave it is advantageous to maintain a mildly oxidizing temperature by feeding air therein. The secondary nickel sulfide NiS created in the second atmospheric leaching is dissolved in the reactions taking place between the said nickel sulfide NiS, copper sulfate and water, so that after this leaching step, all of the nickel can be said to have been dissolved. In the leaching process, copper is precipitated as digenite $Cu_{1.8}S$, and the secondary copper sulfide CuS also reacts partly with copper sulfate, thus creating more digenite and sulfuric acid. In these conditions, the iron contained in the leaching cycle is dissolved so that there is created bivalent, soluble ferrosulfate. From the leaching step, the created solution is conducted, after the precipitate separation step 8, to the leaching step 9 of electric furnace matte.

Generally a matte with a high iron content is electric furnace matte (EF matte), but also ferronickel matte proper can be leached in the process step according to the present invention. The matte also contains a small amount of copper and cobalt. The amount of sulfur is fairly small, and thus iron and nickel can be considered to be present in the matte mainly in elemental form. Into the leaching step 9, there is also conducted some oxygen-bearing gas, such as oxygen or air, because the oxidation of iron into trivalent state is dependent, among other factors, on the partial pressure of oxygen. If air is used in the oxidation, it is clear that the reactions proceed more slowly than with oxygen. The temperature of the leaching-precipitation step is at least 80° C., advantageously at least 90° C., in order to obtain a precipitate that can be filtered in practical conditions. Into the leaching step there is also conducted sodium sulfate created in the preceding process steps, for instance in the solution purification 4, in order to precipitate the created trivalent iron as jarosite. If the amount of the sodium sulfate coming from the process steps is not sufficient, a suitable Na compound is separately fed into the process. On the other hand, if there is an excess of sodium sulfate, it is crystallized. When beginning the leaching-precipitation step, jarosite nuclei are fed into the step in order to initiate the precipitation, but in a continuous process the later addition of nuclei is not necessary, because in the precipitation step there always remains a sufficient amount of crystal nuclei.

The following reactions take place in the leaching step of the EF matte:

$$Ni^0 + H_2SO_4 + \tfrac{1}{2}O_2 \longrightarrow NiSO_4 + H_2O \tag{1}$$

$$6Fe^0 + Na_2SO_4 + 3H_2SO_4 + 4\tfrac{1}{2}O_2 + 6H_2O \longrightarrow 2NaFe_3(SO_4)_2(OH)_6 \tag{2}$$

The bivalent ferrous iron obtained from the leaching of smelting matte is precipitated as follows:

$$3Fe^0 + 3FeSO_4 + Na_2SO_4 + 3O_2 + 6H_2O \longrightarrow 2NaFe_3\,(SO_4)_2\,(OH)_6 \tag{3}$$

Arsenic and antimony are also precipitated into the jarosite precipitate. The nickel-sulfate-bearing solution obtained in the separation step 10 and containing also other valuable minerals in dissolved form is conducted back into the second atmospheric leaching 2. The created jarosite precipitate is processed in a suitable fashion; it can be fed back into the pyrometallurgical process or discarded.

As was maintained above, we have now discovered that the dissolution rate of iron-bearing matte is not very much dependent on the oxygen content in the solution, but on the other hand the precipitation rate of iron is remarkably increased when the acid content is reduced. Therefore it is advantageous to adjust the leaching conditions of EF matte in the pH region 1–2.5, advantageously 1.2–2.2, where the amount of free acid contained in the solution is only a few grams per liter. Consequently the solution obtained from the first autoclave leaching is extremely suitable for the leaching of EF matte. In order to correctly adjust the degree of oxidation, redox measurements can be applied, and in the precipitation of iron, the redox potential with respect to the hydrogen electrode must be at least +700 mV.

When necessary, iron can also be precipitated as goethite, and in that case the pH of the solution is advantageously adjusted within the region 2–3. The temperature can be lower than in jarosite precipitation, i.e. 60–100° C. Iron can also be precipitated as hematite. In both cases, corresponding crystal nuclei must be conducted into the precipitation step when starting the process. When the precipitation takes place as goethite or hematite, sodium sulfate is not needed in the precipitation step.

It is also clear that the leaching of a matte with a high iron content can be carried out with a solution obtained from some other leaching step of the smelting matte, but generally the solution obtained from the first pressure leaching is advantageous for the bulk precipitation of iron and for the leaching of nickel. The leaching can also be carried out for instance with a solution obtained from the second atmospheric leaching. In that case in the second atmospheric leaching, the pH of the solution is adjusted to be about 3, and the maximum redox potential with respect to the hydrogen electrode is +700 mV, advantageously about +500 mV, so that the iron is maintained bivalent in the solution. In this alternative, the solution created in the leaching of EF matte is fed back into the leaching cycle of the smelting matte, into the first atmospheric leaching. Apart from the above described process, the leaching of iron-rich matte can also be carried out by conducting solution both from the autoclave leaching step and from the second atmospheric leaching step, so that the solution created in the leaching of iron-rich matte is conducted to the leaching cycle of the low-iron matte, to the first atmospheric leaching.

In the leaching cycle of the low-iron matte, the precipitate obtained from pressure leaching 7 and separated in the separation step 8 is a precipitate containing mainly the copper and precious metals. It is a particular advantage of the method that the precious metals are separated into a precipitate with a low iron content. The precious-metal-bearing precipitate can be processed according to the needs of the situation: if a pyrometallurgical copper process is available, the precipitate can be conducted there, but in other cases the precipitate can be processed further for example in the second pressure leaching step; from the resulting precipitate there can be separated precious metals, from the solution there can be crystallized copper sulfate and produced cathode copper or copper powder with hydrogen reduction, according to known methods.

The above specification describes a nickel recovery method based on the principle that the nickel sulfate solution created in the leaching of nickel matte is conducted into nickel electrowinning and the anolyte of the nickel electrowinning is used in the leaching of the matte. However, within the scope of the invention the reduction of nickel sulfate into metallic nickel can be performed in other ways, too, for instance as hydrogen reduction, in which case the leaching is carried out into some other sulfuric-acid-bearing solution instead of the anolyte. Likewise, part of the solution can be fed into electrowinning and part can be reduced in some other way.

The invention is further described with reference to the examples below.

EXAMPLE 1

25 g electric furnace matte was leached into an acidic solution at the temperature of 95° by oxidizing with oxygen gas. The proceeding of the experiment is described in the following table.

| | Solid | | | | Solution | | | | |
|---|---|---|---|---|---|---|---|---|---|
| h | Ni | Cu | Fe | S | Ni | Cu | Fe | $H_2SO_4$ | pH |
| | | % | | | | g/l | | | |
| 0 | 50.2 | 13.6 | 29.8 | 7.3 | 98 | 1.8 | 2.4 | 35 | |
| 2 | 13.7 | 5.2 | 26.5 | | | 3 | 6.7 | | 2.5 |
| 4 | 1.5 | 0.9 | 48 | | | 4 | 5.9 | | 2.3 |
| 6 | 0.9 | 0.8 | 50 | | | 4 | 4.6 | | 2.3 |

The experiment shows that nickel dissolves at the same time as iron precipitates. The created precipitate is goethite and filters poorly. The iron content in the solution was higher than in the initial situation. The percentage of precipitation was about 70%.

EXAMPLE 2

A similar experiment as in example 1 was carried out, but 25 g jarosite nuclei was added in order to enhance precipitation. The first row of the table gives the analysis of the initial jarosite as well as the analysis of the matte and jarosite mixture.

The experiment shows that the nickel contained in the matte is dissolved nearly completely (99.4%), when the outcoming jarosite (last row of the table) is purer than the one fed in. Thus it can be maintained, that the yield is extremely good, and more iron was precipitated than was fed in along with the matte: the Fe content in the initial solution was 3.8 g/l, the final Fe value was 2.4 g/l. The filtration capacity was good.

The solution used in this experiment was made by leaching low-iron matte according to the process flowchart. The solution was obtained from step 7. The experiment shows that the iron leached at this stage can be at least partly precipitated.

| | Solid | | | | Solution | | | | |
|---|---|---|---|---|---|---|---|---|---|
| h | Ni | Cu | Fe | S | Ni | Cu | Fe | $H_2SO_4$ | pH |
| | | % | | | | g/l | | | |
| 0 | 1.1 | 0.33 | 31.3 | 14.3 | | | | | |
| 0 | 25.6 | 7.0 | 30.5 | | 76 | 1.8 | 3.8 | 35 | |
| 4 | 2.6 | 5 | 29.4 | | | 2.6 | 8.9 | | 2.4 |
| 8 | 2.7 | 2.7 | 30.5 | | | 3.9 | 4.8 | | 2.2 |
| 12 | 1.3 | 1.1 | 32.5 | | | 4.7 | 3.5 | | 2.2 |
| 16 | 0.73 | 0.48 | 32.5 | 13.6 | | 4.7 | 2.4 | | 2.0 |

EXAMPLE 3

As examples 1 and 2 show, the oxidation of the iron is the slowest stage in the process. This is obvious, because the partial pressure of oxygen at the temperature of 95° C. is about 0.15 bar. In a large scale-operation, a useful help is the often remarkable static pressure—or then at least an excessive pressure in the region of 0.3–0.5 bar is easily arranged.

In order to intensify the effect of the pressure there was carried out a series of experiments, where experiment 2 was repeated in a pressure tank with various partial pressures of oxygen. The iron content of the solution was observed and is described in the FIG 2. In a situation corresponding to example 2, the partial pressure of oxygen is 0.15 bar, and the points located on the respective curve are marked with x. The 0.5 bar curve in the diagram corresponds to conditions where the reactor is 3 m high, and the points located on the respective curve are marked with 0. The conditions of the 1 bar curve are easily achieved in a production-scale process. In the diagram this curve is represented lowest, and the points are marked with ◇.

We claim:

1. A method for recovering nickel and other valuable metals and for precipitating iron from first and second pyrometallurgically produced mattes, wherein the first matte contains a smaller proportion of iron than the second matte, comprising:

(a) leaching the first matte in a first leaching cycle including at least one atmospheric leaching step and at least one pressure leaching step each using a leaching solution containing nickel sulfate and sulfuric acid, whereby nickel of the first matte dissolves as nickel sulfate in each leaching step of the first leaching cycle and iron of the first matte dissolves in a leaching step of the first leaching cycle to form an iron-bearing solution, (b) reducing nickel sulfate solution from the first leaching cycle to metallic nickel, (c) leaching the second matte in a second leaching cycle using the iron-bearing solution formed in step (a) with pH adjusted to at least 1, whereby the nickel of the second matte dissolves as nickel sulfate, and (d) using the nickel sulfate solution formed in step (c) as a leaching solution in a leaching step of the first leaching cycle.

2. A method according to claim 1, wherein step (c) comprises leaching the second matte in the second leaching cycle using the iron-bearing solution formed in step (a) with pH adjusted to the range 1–2.5.

3. A method according to claim 2, comprising feeding sodium sulfate and an oxygen-bearing gas to step (c).

4. A method according to claim 2, wherein step (c) is carried out at a temperature of at least 80° C.

5. A method according to claim 1, wherein step (c) comprises leaching the second matte in the second leaching cycle using the iron-bearing solution formed in step (a) with pH adjusted to the range 2–3.

6. A method according to claim 5, wherein step (c) is carried out at a temperature of at least 60° C.

7. A method according to claim wherein step (c) is carried out at a temperature in the range from 60–100° C.

8. A method according to claim 1, wherein step (c) includes precipitating arsenic and antimony.

9. A method according to claim 1, wherein the iron-bearing solution used in step (c) is taken from a pressure leaching step of the first leaching cycle.

10. A method according to claim 9, wherein the first leaching cycle includes first and second consecutive atmospheric leaching steps and step (d) comprises using the nickel sulfate solution formed in step (c) as a leaching solution in the second atmospheric leaching step.

11. A method according to claim 10, wherein the first leaching cycle includes first and second consecutive atmospheric leaching steps and step (a) includes using the nickel sulfate solution formed in the second atmospheric leaching step as a leaching solution in the first atmospheric leaching step.

12. A method according to claim 1, wherein the first leaching cycle includes first and second consecutive atmospheric leaching steps and the iron-bearing solution used in step (c) is taken from the second atmospheric leaching step of the first leaching cycle.

13. A method according to claim 12, wherein step (d) includes using the nickel sulfate solution formed in step (c) as a leaching solution in the first atmospheric leaching step.

14. A method according to claim 1, wherein the first leaching cycle includes first and second consecutive atmospheric leaching steps and step (a) includes using the nickel sulfate solution formed in the second atmospheric leaching step as a leaching solution in the first atmospheric leaching step.

15. A method according to claim 1, wherein the step of reducing the nickel sulfate solution to metallic nickel comprises nickel electrowinning, which produces an anolyte containing nickel sulfate, and the method includes supplying the anolyte to the first leaching cycle as a leaching solution.

16. A method according to claim 1, wherein step (c) includes providing precipitation nuclei for precipitation of iron, whereby both the iron of the second matte and the iron present in the iron-bearing solution precipitate.

17. A method according to claim 16, wherein step (c) comprises leaching the second matte in the second leaching cycle using the iron-bearing solution formed in step (a) with pH adjusted to the range 1–2.5 and the iron is precipitated as jarosite.

18. A method according to claim 16, wherein step (c) comprises leaching the second matte in the second leaching cycle using the iron-bearing solution formed in step (a) with pH adjusted to the range 2–3 and the iron is precipitated as goethite.

* * * * *

UNITED STATES PATENT AND TRADEMARK OFFICE
CERTIFICATE OF CORRECTION

PATENT NO. : 6,039,790
DATED : March 21, 2000
INVENTOR(S) : Stig-Erik Hultholm and Sigmund Peder Fugleberg It is certified that error appears in the above-identified patent and that said Letters Patent is hereby corrected as shown below:

Title page, Left Column, "[73] Assignee: Outkumpu Technology Oy, Espoo, Finland" should be deleted and replaced with --[73] Assignee: Outokumpu Technology Oy, Espoo, Finland--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*